US011712786B2

(12) United States Patent
Shen

(10) Patent No.: US 11,712,786 B2
(45) Date of Patent: Aug. 1, 2023

(54) PLIERS HEAD AND PLIERS WITH GOOD SUITABILITY

(71) Applicants: Zhuji ITOP Hardware Tools Co., Ltd., Zhuji (CN); Zhejiang Iwiss Electric Co., Ltd., Leqing (CN)

(72) Inventor: Yuejuan Shen, Zhuji (CN)

(73) Assignees: Zhuji ITOP Hardware Tools Co., Ltd., Zhuji (CN); ZHEJIANG IWISS ELECTRIC CO., LTD., Lishui (CN)

( * ) Notice: Subject to any disclaimer, the term of this patent is extended or adjusted under 35 U.S.C. 154(b) by 257 days.

(21) Appl. No.: 17/303,768

(22) Filed: Jun. 7, 2021

(65) Prior Publication Data

US 2022/0212317 A1 Jul. 7, 2022

(30) Foreign Application Priority Data

Jan. 5, 2021 (CN) ..... 202120013946.7

(51) Int. Cl.

| | |
|---|---|
| ***B25B 7/04*** | (2006.01) |
| ***B25B 5/16*** | (2006.01) |
| *B25G 1/06* | (2006.01) |
| *B25B 7/22* | (2006.01) |

(52) U.S. Cl.

CPC ..... *B25B 7/04* (2013.01); *B25B 5/166* (2013.01); *B25B 7/22* (2013.01); *B25G 1/06* (2013.01)

(58) Field of Classification Search

CPC .. B25B 7/02; B25B 7/04; B25B 5/163; B25B 5/166; H01R 43/042

USPC ..... 81/421, 422, 423

See application file for complete search history.

(56) References Cited

U.S. PATENT DOCUMENTS

| | | | | |
|---|---|---|---|---|
| 240,067 | A * | 4/1881 | Worden | B25B 7/04 81/178 |
| 1,766,459 | A * | 6/1930 | Schweigert | B25B 7/04 81/186 |
| 2,869,407 | A * | 1/1959 | Swanson | H01R 43/0427 81/301 |
| 3,383,963 | A * | 5/1968 | Vondrachek | B25B 7/04 81/177.85 |
| 6,053,025 | A * | 4/2000 | Beetz | B25B 27/146 72/413 |
| 6,721,983 | B2 * | 4/2004 | Dallas | B25F 1/04 7/128 |
| 9,089,958 | B2 * | 7/2015 | Cleland | B23D 21/02 |
| 9,166,353 | B1 * | 10/2015 | Doornbos | B21D 39/048 |
| 10,071,449 | B1 * | 9/2018 | Donofrio | B26F 1/0015 |
| 10,150,153 | B1 * | 12/2018 | Goede | A61C 7/04 |
| 2002/0117029 | A1 * | 8/2002 | Lin | B25B 7/04 81/423 |

(Continued)

*Primary Examiner* — Bryan R Muller

(74) *Attorney, Agent, or Firm* — Schwegman Lundberg & Woessner, P.A.

(57) ABSTRACT

A plier head with good adaptability and a plier are provided. The plier head includes a left plier head and a right plier head, a left accessory and a right accessory matched with each other. The left accessory is detachably connected to the left plier head, the right accessory is detachably connected to the right plier head, and the right accessory and the left accessory cooperate with each other to form at least one cavity. At least two use states include a first state and a second state. When the plier head is in the first state or the second state, a position of the at least one cavity can be changed.

14 Claims, 11 Drawing Sheets

(56) References Cited

U.S. PATENT DOCUMENTS

2009/0031778 A1* 2/2009 Hamm ..... B25B 25/005
72/407
2011/0154958 A1* 6/2011 Wang ..... B25B 27/0071
81/302

* cited by examiner

PLIERS HEAD AND PLIERS WITH GOOD SUITABILITY

CROSS-REFERENCE TO RELATED APPLICATIONS

This Non-provisional application claims priority under 35 U.S.C. § 119(a) to Chinese Patent Application No. 202120013946.7 filed on Jan. 5, 2021, the entire contents of which are hereby incorporated by reference in their entirety.

TECHNICAL FIELD

The disclosure relates to the technical field of tools, in particular to a plier head with good adaptability and a plier.

BACKGROUND ART

A plier is a hand tool for clamping and fixing workpieces or for twisting, bending and cutting a metal wire. Common pliers include Slip Joint Pliers, Hose Clamp Pliers, Needle Nose Pliers, Tongue and Groove Pliers, Bent Nose Pliers, Flat Nose Pliers, Locking Pliers, Snap Ring Pliers, Oil Filter Pliers, etc.

In use, users often need to change pliers with different sizes according to different sizes of objects to be clamped, such as clamps and pipes, which causes inconvenience to users. Moreover, in order to meet different needs in daily use, users need to buy tools of a whole set of sizes, which not only wastes but also takes up a lot of space.

A plier head of some existing plier can be replaced by that of a different size, so that it can be adapted to objects to be clamped with different sizes. However, the replaced plier head is prone to be lost, and the dismantling and mounting of the plier head is complicated.

SUMMARY

An object of the disclosure is to provide a plier head which is not prone to losing accessories and have good adaptability and a plier.

In order to solve the above technical problems, the disclosure provides a plier head with good adaptability, which includes a left plier head and a right plier head, a left accessory and a right accessory matched with each other. The left accessory is detachably connected to the left plier head, the right accessory is detachably connected to the right plier head, and the right accessory and the left accessory cooperate with each other to form at least one cavity. At least two use states include a first state and a second state. When the plier head is switched into the first state or the second state, a position of the at least one cavity can be changed.

By adjusting the use state of the plier head, the position of at least one cavity is changed to meet different requirements, so as to provide good adaptability with only one tool. Furthermore, in different states, both the left and right accessories need to be used in pairs, that is to say, no spare accessory is required to be replaced, so as to achieve a purpose that the accessory is not easy to be lost. Secondly, the at least one cavity can be used for clamping and mounting a clamped object.

Optionally, when the plier head is in the first state, the left accessory and the right accessory are positively connected with the left plier head and the right plier head respectively; and when the plier head is in the second state, the left accessory and the right accessory are reversely connected with the left plier head and the right plier head respectively.

By adjusting a connection mode (a positive connection or a reverse connection) between the left accessory and the left plier head, the right plier head and the right accessory, the use state of the plier head can be adjusted to meet different requirements. In a possible embodiment, the use state of the plier head can also be adjusted by replacing different left and right accessories, that is, a same plier head can be provided with multiple sets of left and right accessories, and different functions can be realized with different sets of accessories and/or different shapes or sizes of the right accessory.

The first state and the second state in this application can be any one of a state for clipping, clamping, cutting, a state for clamping and mounting of relatively large-sized objects to be clamped, and a state for clamping and mounting of relatively small-sized objects to be clamped.

Optionally, the number of at least one cavity may be one, two, three, four, five, six, or the like. When the number of the cavities is two, two cavities (a first cavity and a second cavity) are respectively arranged at the two ends of the left and right accessories, and the two cavities are of different sizes. When the plier head is in the first state, the left and right accessories are positively connected to the left and right plier heads, respectively, and the first cavity is located proximate to a jaw; and when the plier head is in the second state, the left and right accessories are reversely connected to the left and right plier heads respectively, and the second cavity is located proximate to the jaw. When the number of the cavity is one, the cavity is arranged at an end of the left or right accessory, and the other end of the left or right accessory can be provided with a matched cutter. When the plier head is in the first state, the cavity is proximate to the jaw, and when the plier head is in the second state, the cutter is proximate to the jaw. An end to be used is provided proximate to the jaw, which is convenient for operation in a dead corner such as a corner of a wall.

Optionally, the positive or reverse connection of the left accessory to the left plier head is determined by turning over the left accessory and the positive or reverse connection of the right accessory to the right plier head is determined by turning over the right accessory, so as to switch different use states of the plier head. In another possible embodiment, the positive or reverse connection of the left accessory to the left plier head can also be determined by moving the left accessory and the positive or reverse connection of the right accessory to the right plier head can also be determined by moving the right accessory, so as to switch different use states of the plier head. In another possible embodiment, the positive or reverse connection of the left accessory to the left plier head can also be determined by moving and turning over the left accessory and the positive or reverse connection of the right accessory to the right plier head can also be determined by moving and turning over the right accessory, so as to switch different use states of the plier head.

Optionally, the left plier head has a left accommodating cavity for accommodating the left accessory, and the right plier head has a right accommodating cavity for accommodating the right accessory. Inner walls of the left accommodating cavity and the right accommodating cavity are symmetrical with respect to a symmetrical plane, so that both the right and left accessories in positive connection or reverse connection can be placed in respective accommodating cavities. Optionally, the left accommodating cavity and the right accommodating cavity may be completely communicated, or in other embodiments, the left accommodating cavity and the right accommodating cavity may not be completely communicated.

Optionally, a baffle is provided on a side of each of the left and right accommodating cavities, and a fixing structure is provided on the other side of each of the left and right accommodating cavities to fix positions of the left and right accessories, and the left and right accessories both can be detached unidirectionally. The baffle can be integrally formed with the left or right plier head. In another possible embodiment, the baffle is mounted to the left or right plier head, which facilitates the processing of the left and right accommodation cavities. In another possible embodiment, both sides of the left and right accommodation chambers can be fixed structures, and in this case the left and right accessories both can be detached bidirectionally.

Optionally, each fixing structures includes a fixing piece and at least two shafts, an end of the fixing piece is rotatable around one of the shafts, the other end of the fixing piece is provided with a sliding hole or a sliding groove, and the other of the shafts is inserted into the sliding hole or the sliding groove and is slidably arranged along the sliding hole or the sliding groove so that the fixing piece completely exposes or partially covers the left or right accommodating cavity. When the fixing piece completely exposes the left accommodating cavity, the left accessory can be taken out from the left accommodating cavity; and when the fixing piece partially covers the left accommodating cavity, both sides of the left accessory are restricted by the fixing piece and the baffle respectively, thus fixing the left accessory, and the case is the same for the right accessory. In some other embodiments, the fixing structure can also be other types, for example, it can completely expose or partially cover the accommodating cavity by turning the fixing piece around the axis, or it can also completely expose or partially cover the accommodating cavity by a cooperation of a limiting block with a limiting groove. Specifically, the fixing structure includes the limiting block; and the plier head and accessories are provided with limiting protrusions or limiting grooves and the limiting block is provided with a limiting groove or a limiting protrusion matched with the limiting protrusions or the limiting grooves, and the limiting block slides along the limiting protrusions or the limiting grooves so as to completely expose or partially cover the accommodating cavity; and a shape of the limiting block can be L-shaped or U-shaped, and the plier head and accessories can be fixed at a corner. There can be either one fixing structure or multiple fixing structures to achieve better fixing.

Optionally, each baffle is fixed on a side of the left or right accommodating cavity through at least two shafts, which facilitates mounting of the baffle and the fixing structure.

Optionally, the inner wall of the left accommodating cavity and the left accessory are respectively provided with a matched left protrusion and a left groove matched with the left protrusion, and the inner wall of the right accommodating cavity and the right accessory are respectively provided with a right protrusion and a right groove matched with the right protrusion. Furthermore, the left protrusion and the right protrusion are both columnar in shape, more preferably, enlarged-upper-reduced-lower columnar in shape, that is, a part of the protrusion proximate the fixed structure is larger than a part of the protrusion proximate the baffle.

Optionally, the left protrusion and the right protrusion both includes a tongue and a neck. The tongue is connected to the left accessory or the inner wall of the left accommodating cavity through the neck, and the tongue is provided to limit a position of the left accessory, and the case is the same for the shape of the right protrusion.

Optionally, there may be only one pair of left protrusion and left groove which are provided proximate to the symmetrical plane, and there may be only one pair of right protrusion and right groove which are also provided proximate to the symmetrical plane. In another possible embodiment, there may be provided two pairs of left protrusions and left grooves, and two pairs of right protrusions and right grooves, which are respectively arranged at two ends of the accommodating cavity. In other embodiments, there may be provided three, four, five, six, seven, eight, nine, ten or the like pairs of left protrusions and left grooves, and the right protrusions and right grooves. A number of the left protrusions and left grooves can be equal to or different from that of the right protrusions and right grooves.

Optionally, two ends of the inner wall of the left accommodating cavity extend toward inside of the left accommodating cavity, and two ends of the inner wall of the right accommodating cavity extend toward inside of the right accommodating cavity, so as to further fix the left accessory and the right accessory.

Optionally, an end of the plier head can be a blunt end or an elbow. Optionally, ends of the left plier head and the right plier head proximate to a jaw are respectively provided with a left clipping part and a right clipping part which are matched with each other for clipping.

Optionally, the plier head also has a third state and a fourth state. When the plier head is in the third state, the left accessory is positively connected to the left plier head and the right accessory is reversely connected to the right plier head; and when the plier head is in the fourth state, the left accessory is reversely connected to the left plier head, and the right accessory is positively connected to the right plier head. The third state and the fourth state can be any one of a state for clipping, clamping, cutting, a state for clamping and mounting of relatively large-sized objects to be clamped, and a state for clamping and mounting of relatively small-sized objects to be clamped.

The disclosure also provides a plier, which includes a left plier handle and a right plier handle, any one of the plier head with good adaptability mentioned above, and a pivoting structure. The pivot structure is connected with left plier head, the right plier head, the left plier handle, and the right plier handle respectively.

To sum up, in this disclosure, by adjusting the use state of the plier head, the position of at least one cavity is changed to meet different requirements, so as to provide good adaptability with only one tool. Furthermore, in different states, both the left and right accessories need to be used, that is to say, no spare accessory is required to be replaced, so as to achieve a purpose that the accessory is not easy to be lost. Secondly, the at least one cavity can be used for clamping and mounting a clamped object.

DETAILED DESCRIPTION

Figure 1:
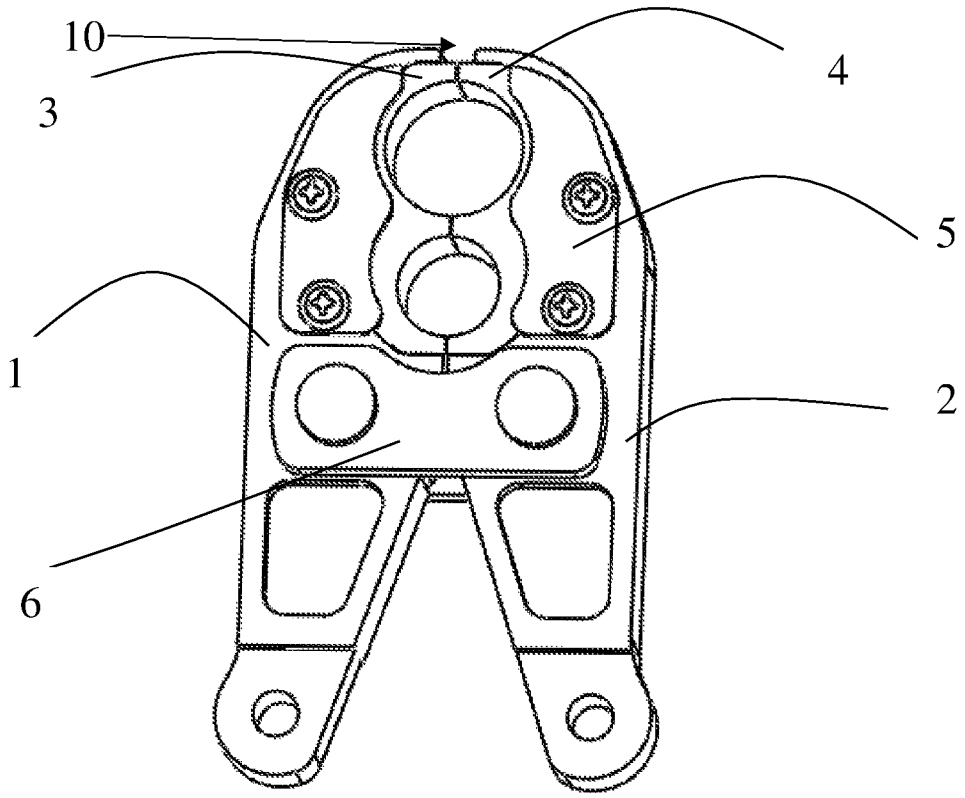
FIG. 1 is a schematic diagram of a side of a plier head with good adaptability according to Embodiment 1 of the disclosure.

The specific implementations of the present disclosure will be described in further detail with reference to the drawings and embodiments. The following examples serve to illustrate the present disclosure, but are not intended to limit a scope of the present disclosure.

The left and right in this disclosure are only for convenience of description; here, the left and right only refer to a relative orientation in position, and in some other embodiments, the left and right can be interchanged.

A positive connection and reverse connection in this disclosure are also for the convenience of description, and refer to two different relative states before and after turning over or other actions of the left accessory and the right accessory. In some other embodiments, the positive connection and the reverse connection can be interchanged.

In this disclosure, inner walls of the left accommodating cavity and the right accommodating cavity are symmetrical about a symmetry plane, which is perpendicular to a plane where a surface of a baffle is located, and which is parallel to a direction of a clipping force of the plier. The term symmetry herein means substantially symmetrical, and a texture, a groove or other fine structures on the inner wall do not have to be symmetrical, so that the left and right accessories before and after turning over can be placed in the left and right accommodation cavities respectively.

Embodiment 1

Now reference is made to FIG. 1 to FIG. 5. A plier head with good adaptability is provided in Embodiment 1, which includes a left plier head 1 and a right plier head 2, a left accessory 3 and a right accessory 4 matched with each other. The left accessory 3 is detachably connected to the left plier head 1, the right accessory 4 is detachably connected to the right plier head 2, and the right accessory 4 and the left accessory 3 cooperate with each other to form at least two cavities (a first cavity 82 and a second cavity 81). The plier head has two use states which are a first state and a second state respectively. When the plier head is in the first state or the second state, the positions of the first cavity 82 and the second cavity 81 can be changed. When the plier head is in the first state, the left accessory 3 and the right accessory 4 are positively connected with the left plier head 1 and the right plier head 2 respectively; and when the plier head is in the second state, the left accessory 3 and the right accessory 4 are reversely connected with the left plier head 1 and the right plier head 2 respectively.

By adjusting a connection mode (a positive connection or a reverse connection) between the left accessory 3 and the left plier head 1, the right plier head 2 and the right accessory 4, the use state of the plier head can be adjusted to meet different requirements, so that good adaptability can be achieved with one tool. Furthermore, in different states, both the left 3 and right 4 accessories need to be used, that is to say, no spare accessory is required to be replaced, so as to achieve a purpose that the accessory is not easy to be lost. Secondly, the at least one cavity can be used for clamping and mounting a clamped object.

Figure 2:
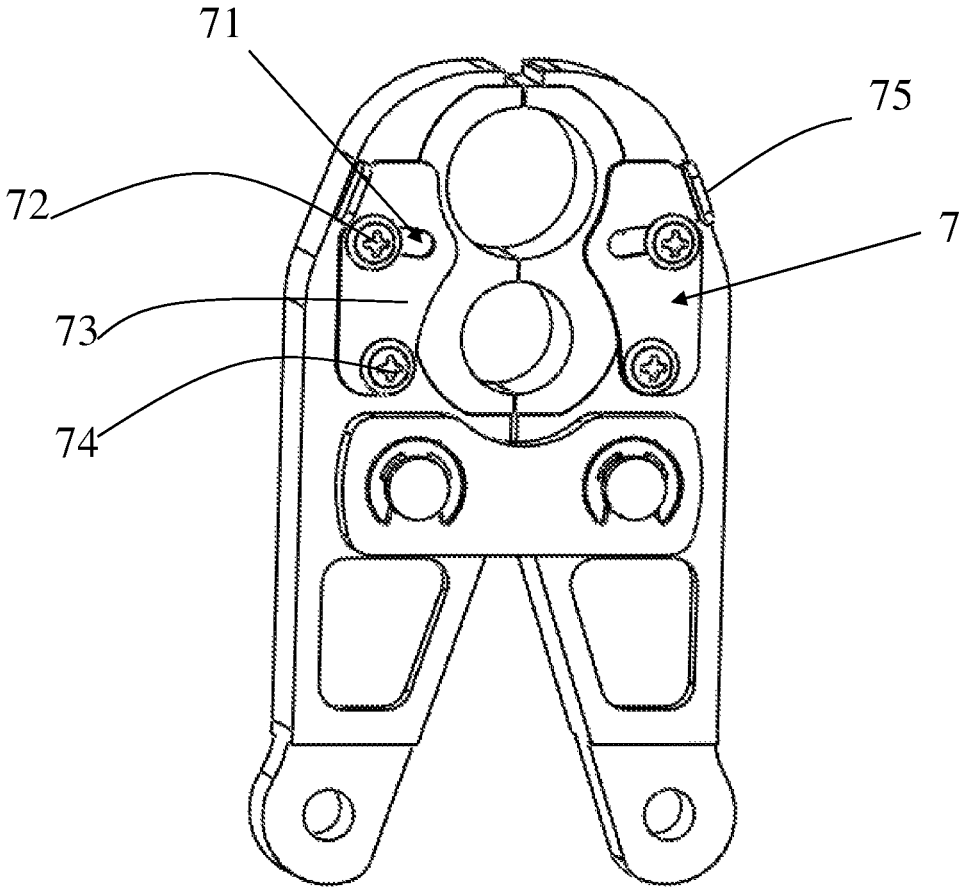
FIG. 2 is a schematic diagram of another side of a plier head with good adaptability according to Embodiment 1 of the disclosure.
Figure 3:
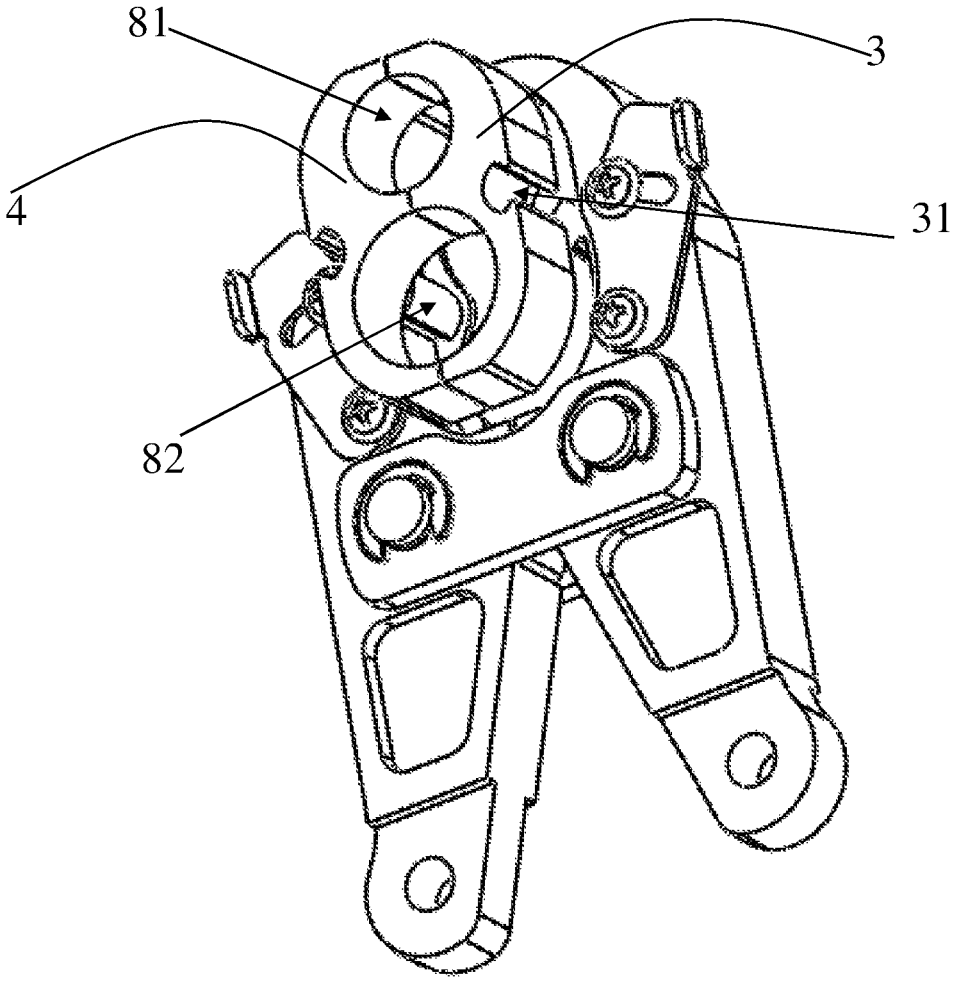
FIG. 3 is a schematic diagram of a plier head in which a left accessory and a right accessory are taken out after a fixing structure is opened according to Embodiment 1 of the disclosure.
Figure 4:
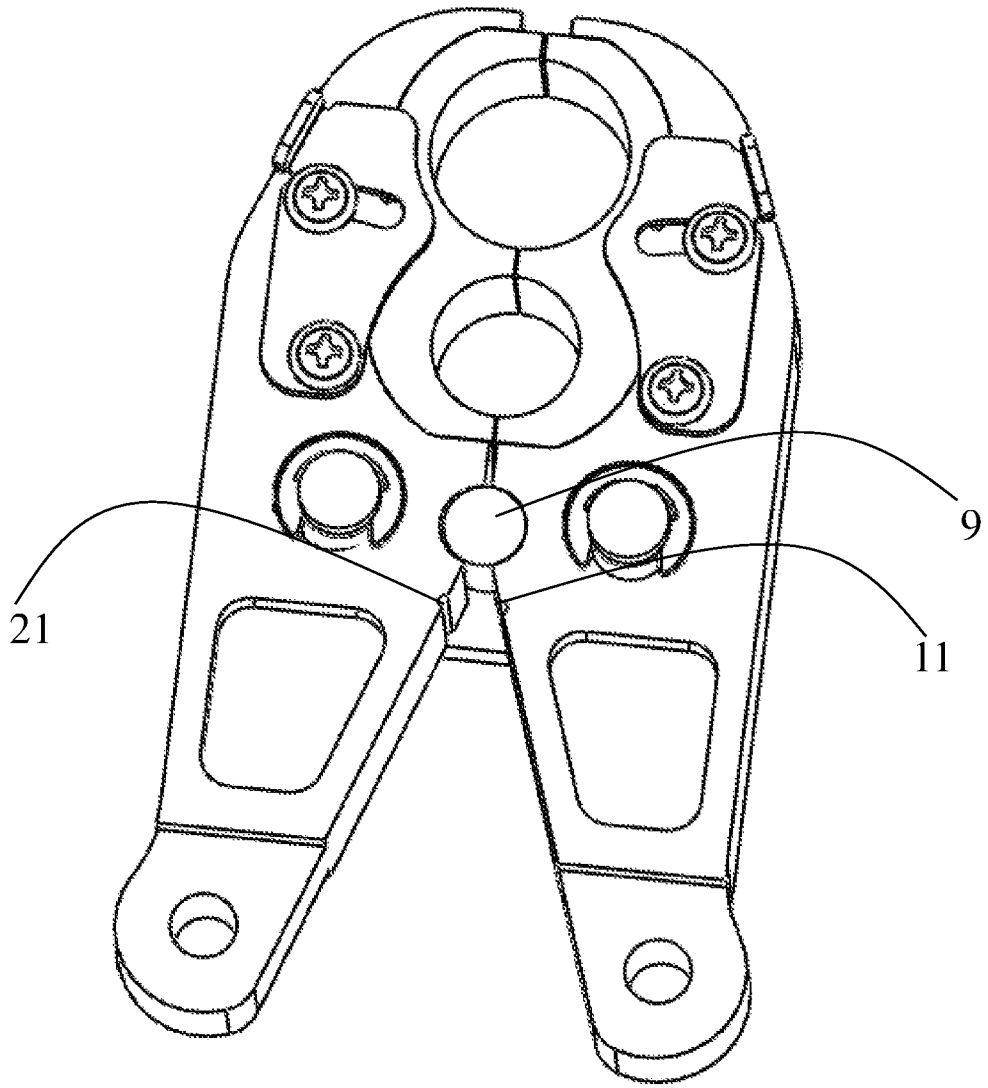
FIG. 4 is a schematic diagram of a plier head with a connecting piece on a side thereof removed according to the Embodiment 1 of the disclosure.

In this embodiment, when the number of the cavities is two, two cavities (a first cavity 82 and a second cavity 81) are respectively arranged at the two ends of the left and right accessories 4, and the two cavities are of different sizes. As shown in FIGS. 1 and 2, when the plier head is in the first state, the left 3 and right 4 accessories are positively connected to the left 1 and right 2 plier heads, respectively, and the first cavity 81 is located proximate to a jaw 10; and as shown in FIG. 3 when the plier head is in the second state, the left 3 and right 4 accessories are reversely connected to the left 1 and right 2 plier heads respectively, and the second cavity 82 is located proximate to the jaw. An end to be used is provided proximate to the jaw, which is convenient for operation in a dead corner such as a corner of a wall. The first state and the second state in this application can be any one of a state for clamping and mounting of relatively large-sized objects to be clamped and a state for clamping and mounting of relatively small-sized objects to be clamped. The shapes of the first cavity and the second cavity are set according to a shape of the object to be clamped.

In this embodiment, the positive or reverse connection of the left accessory 3 to the left plier head 1 is determined by turning over the left accessory 3 and the positive or reverse connection of the right accessory 4 to the right plier head 2 is determined by turning over the right accessory 4, so as to switch different use states of the plier head.

In this embodiment, the left plier head 1 has a left accommodating cavity 13 for accommodating the left accessory 3, and the right plier head 2 has a right accommodating cavity 23 for accommodating the right accessory 4. Inner walls of the left accommodating cavity and the right accommodating cavity are symmetrical with respect to a symmetrical plane, so that both the right and left accessories 4 in positive connection or reverse connection can be placed in respective accommodating cavities. A matched shape of the left accessory 3 and the right accessory 4 is similar to an "8" shape. A shape of a large accommodating cavity formed by the communication between the left accommodating cavity and the right accommodating cavity is nearly elliptical.

In this embodiment, a baffle 5 is provided on a side of each of the left and right accommodating cavities, and a fixing structure is provided on the other side of each of the left 3 and right 4 accommodating cavities to fix the positions of the left and right accessories. The baffle 5 can be integrally formed with the left 1 or right 2 plier head. In another possible embodiment, the baffle 5 is mounted to the left 1 or right 2 plier head, which facilitates the processing of the left and right accommodation cavities.

In this embodiment, each of the fixing structures 7 includes a fixing piece 73 and at least two shafts, an end of the fixing piece 73 can rotate around one 74 of the shafts, the other end of the fixing piece 73 is provided with a sliding hole or a sliding groove 70, and the other 72 of the shafts is inserted into the sliding hole or the sliding groove and is slidably arranged along the sliding hole or the sliding groove so that the fixing piece 73 completely exposes or partially covers the left or right accommodating cavity. When the fixing piece 73 completely exposes the left accommodating cavity, the left accessory 3 can be taken out from the left accommodating cavity; and when the fixing piece 73 partially covers the left accommodating cavity, both sides of the left accessory 3 are restricted by the fixing piece 73 and the baffle 5 respectively, thus fixing the left accessory 3, and the case is the same for the right accessory 4. A side of the fixing piece 73 is also provided with a bending piece 75 for pushing and pulling and being at a certain angle with the fixing piece 73. In this embodiment, the bending piece 75 forms an included angle of 90 degrees with the fixing piece 73, while in other embodiments, the bending piece 75 forms an angle of 30 degrees, 60 degrees, 70 degrees, 100 degrees, 120 degrees and the like with the fixing piece 73.

In this embodiment, each baffle 5 is fixed on a side of the left or right accommodating cavity through at least two shafts, which facilitates mounting of the baffle 5 and the fixing structure 7.

The plier head in this embodiment can be used as follows: after pushing the bending piece, the other shaft slides in the sliding hole or sliding groove to completely expose the left or right accommodating cavity, the left or right accessory 3 or 4 can be taken out, then the left or right accessory 3 or 4 is turned over by 180 degrees and placed in the left or right accommodating cavity; then the bending piece is pushed and the other shaft slides in the sliding hole or slot to partially cover the left or right accommodating cavity and fix the left or right accessory 3 or 4.

Figure 5:
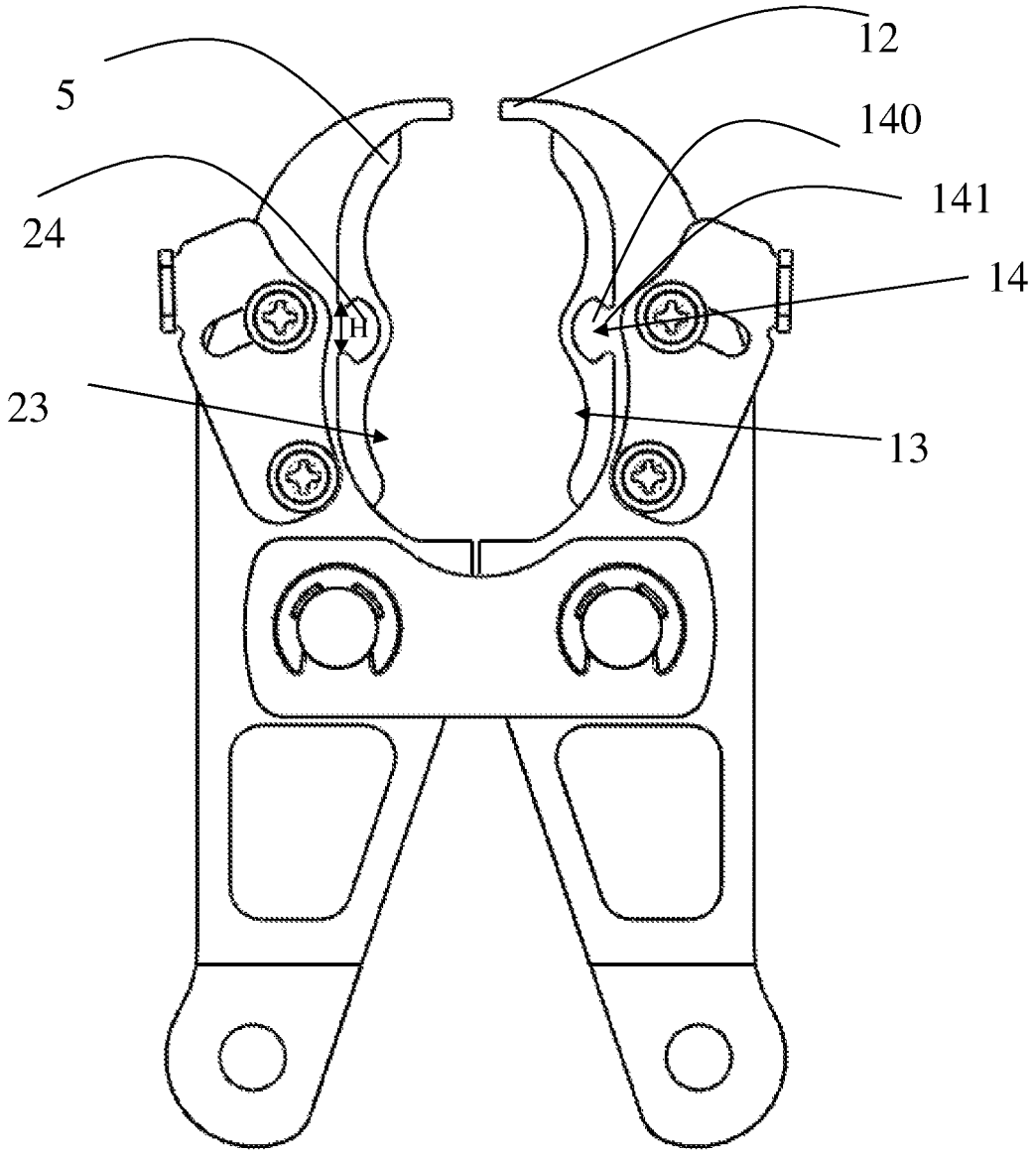
FIG. 5 is a schematic diagram of a plier head in which a left accessory and a right accessory are completely taken out according to Embodiment 1 of the disclosure.

In this embodiment, the inner wall of the left accommodating cavity and the left accessory 3 are respectively provided with a matched left protrusion 14 and a matched left groove 31, and the inner wall of the right accommodating cavity and the right accessory 4 are respectively provided with a matched right protrusion 24 and a right groove. Furthermore, the left protrusion and the right protrusion are both columnar in shape, more preferably, enlarged-upper-reduced-lower columnar in shape, that is, a part of the protrusion proximate the fixed structure 7 is larger than a part of the protrusion proximate the baffle 5. The left protrusion includes a tongue 140 and a neck 141. The tongue is connected to the left accessory 3 or the inner wall of the left accommodating cavity through the neck, and the tongue is provided to limit a position of the left accessory 3; in a height H direction as shown in FIG. 5, the tongue extends from the neck and the height H of the neck gradually increases and finally decreases to 0, and the case is the same for the shape of the right protrusion.

In this embodiment, there may be only one pair of left protrusion and left groove which are provided proximate to the symmetrical plane, and there may be only one pair of right protrusion and right groove which are also provided proximate to the symmetrical plane.

In this embodiment, two ends of the inner wall of the left accommodating cavity extend toward inside of the left accommodating cavity, and two ends of the inner wall of the right accommodating cavity extend toward inside of the right accommodating cavity, that is, the inner walls of the left and right accommodation chambers wrap the left and right accessories, so as to further fix the left accessory 3 and the right accessory 4.

In this embodiment, an end 12 of the plier head is an elbow.

In this embodiment, the plier head also includes a pivot 9 and two connecting pieces 6. The pivot is arranged proximate to the accommodating cavity. The left plier head 1 and the right plier head 2 are connected through the pivot. The two connecting pieces 6 are respectively arranged on two sides of the pivot, and the two connecting pieces 6 are fixedly connected with the left plier head 1 and the right plier head by a connection. The connecting piece 6 is concave with a shape of the accommodating cavity proximate to the accommodating cavity. Two recesses, a left recess 11 and a right recess 21, are provided on sides of the left plier head 1 and the right plier head 2 proximate to the pivot and away from the accommodating cavity.

Figure 6:
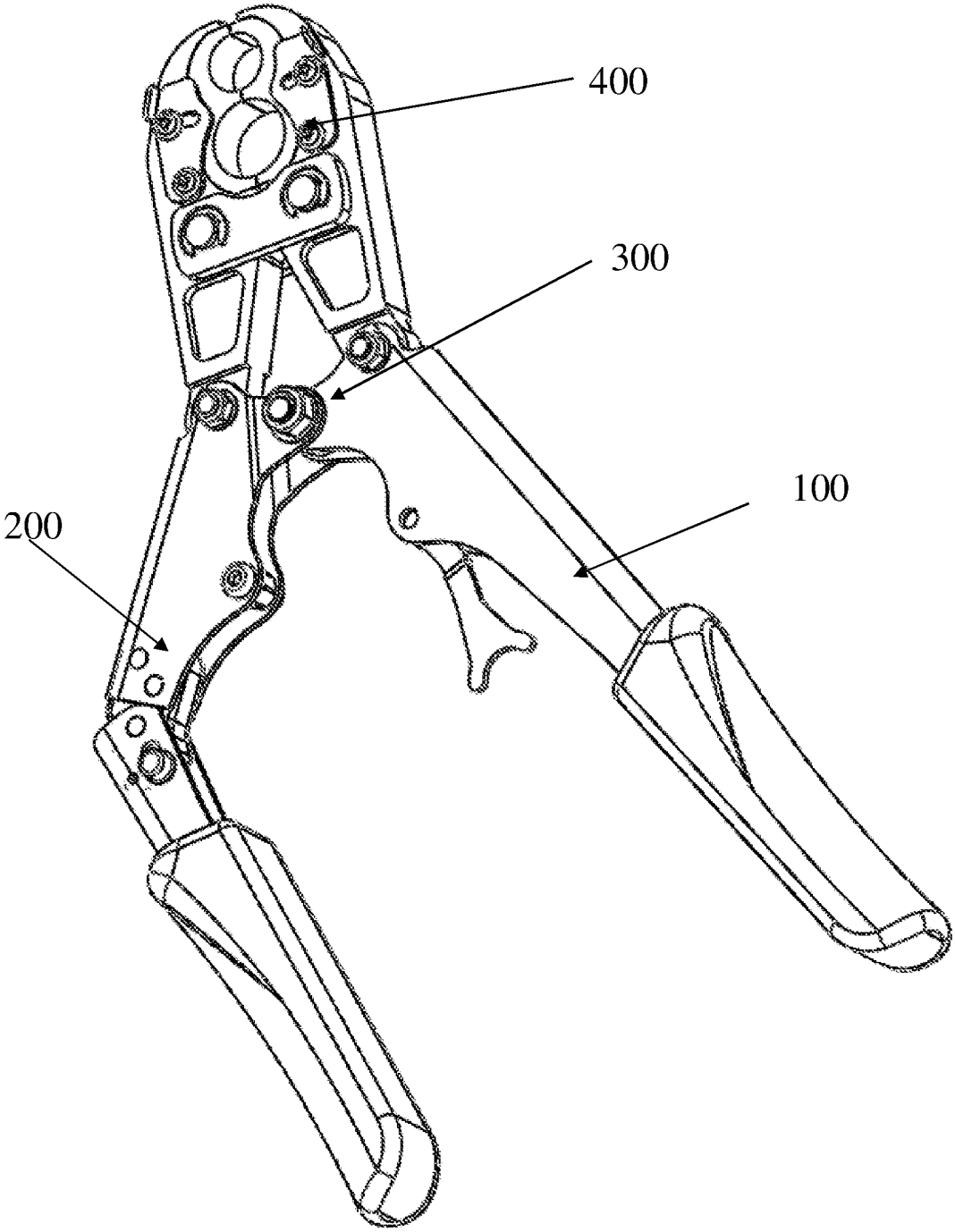
FIG. 6 is a schematic diagram of one of the pliers according to Embodiment 1 of the disclosure.

Now reference is made to FIG. 6. The disclosure also provides a plier, which includes a left plier handle 100 and a right plier handle 200, the plier head 400 with good adaptability described above, and a pivoting structure 300. The pivot structure 300 is connected with the left and right plier heads and the left 100 and right 200 plier handles respectively. When the left 100 and right 200 plier handles are opened, the accommodating cavity is further opened, and it is more convenient to take out the left accessory or the right accessory.

One of the left plier handle 100 and the right plier handle 200 can be bent and folded.

Figure 7:
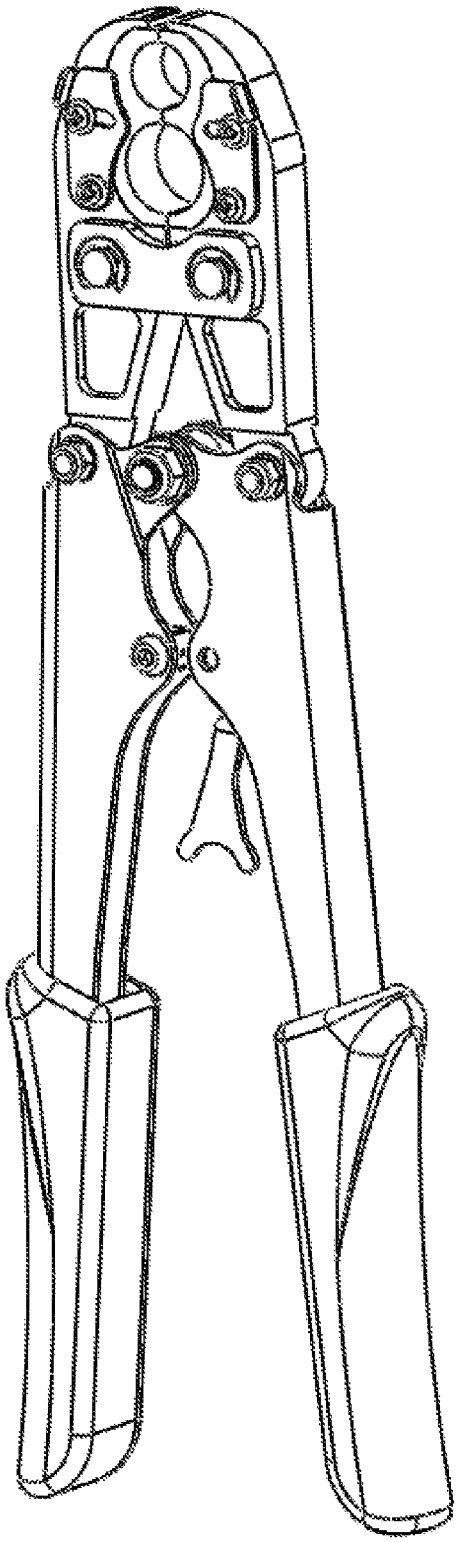
FIG. 7 is a schematic diagram of another one of the pliers according to Embodiment 1 of the disclosure.

Now reference is made to FIG. 7. The disclosure also provides a plier, which includes a left plier handle 100 and a right plier handle 200, the plier head 400 with good adaptability described above, and a pivoting structure 300. The pivot structure is connected with the left and right plier heads and the left 100 and right 200 plier handles respectively. Unlike FIG. 6, the plier handle in FIG. 7 cannot be folded.

Embodiment 2

Figure 8:
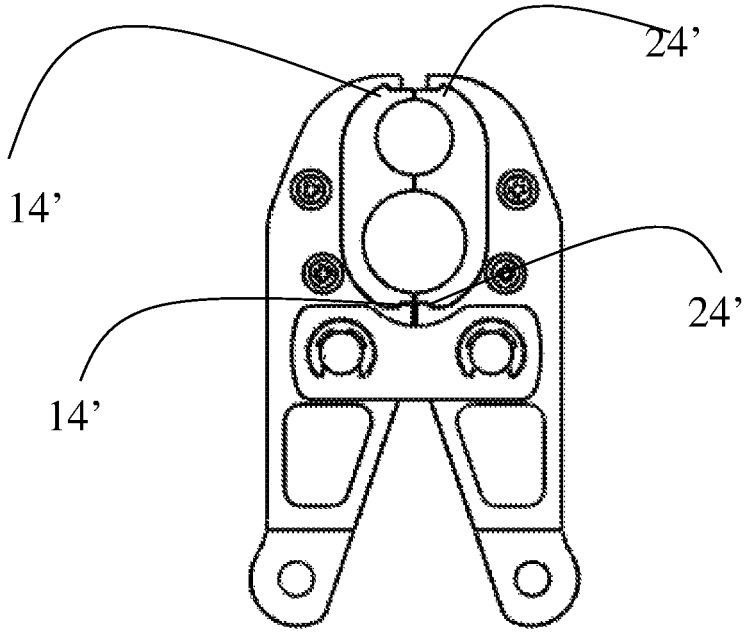
FIG. 8 is a schematic diagram of a plier head with a fixing piece removed according to Embodiment 2 of the disclosure.

Now reference is made to FIG. 8. Embodiment 2 provides another plier head, which is same as the plier head in Embodiment 1 in shape and structure, except for the left accommodating cavity, left accessory, right accommodating cavity and right accessory, and only differences are explained below.

In Embodiment 2, there is provided two pairs of left protrusions 14' and left grooves, and two pairs of right protrusions 24' and right grooves, which are respectively arranged at two ends of the accommodating cavity.

Embodiment 3

Figure 9:
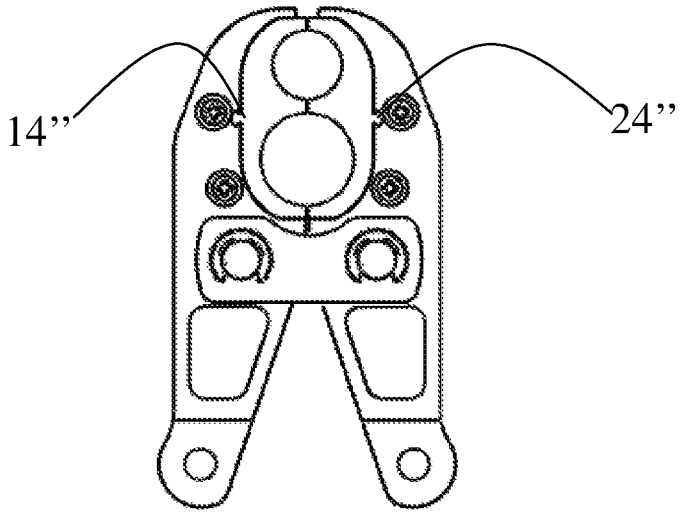
FIG. 9 is a schematic diagram of a plier head according to Embodiment 3 of the disclosure with a fixing piece removed.

Now reference is made to FIG. 9.

Embodiment 3 provides another plier head, which is same as the plier head in Embodiment 1 in shape and structure, except for the left accommodating cavity, left accessory, right accommodating cavity and right accessory, and only differences are explained below.

Relative positions of the left protrusion and the left groove, the right protrusion and the right groove in Embodiment 3 are inconsistent with those in Embodiment 1. The left protrusion 14" and the right protrusion 24" are respectively arranged on the left accessory and the right accessory, and the left groove and the right groove are respectively and correspondingly arranged on the inner wall of the accommodating groove.

Embodiment 4

Figure 10:
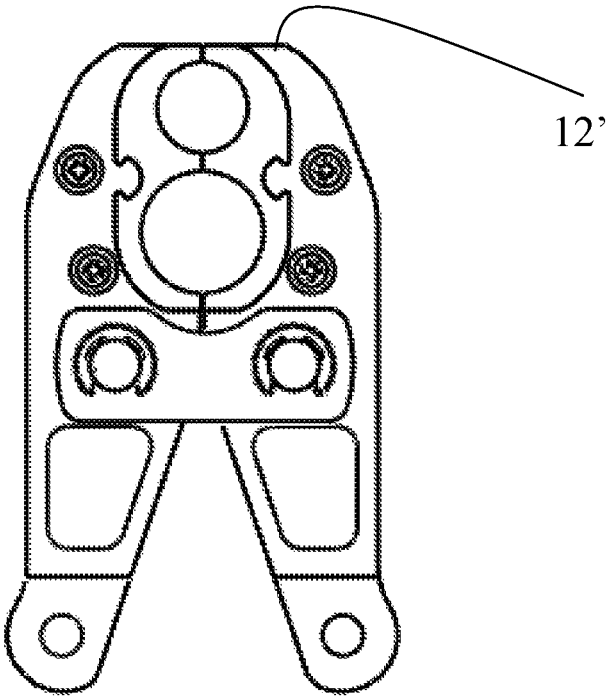
FIG. 10 is a schematic diagram of a plier head with a fixing piece removed according to Embodiment 5 of the disclosure.

Now reference is made to FIG. 10.

Embodiment 3 provides another plier head, which is same as the plier head in Embodiment 1 in shape and structure, except for the plier head, and only differences are explained below.

An end 12' of the plier head in Embodiment 4 is a blunt end.

Embodiment 5

Figure 11:
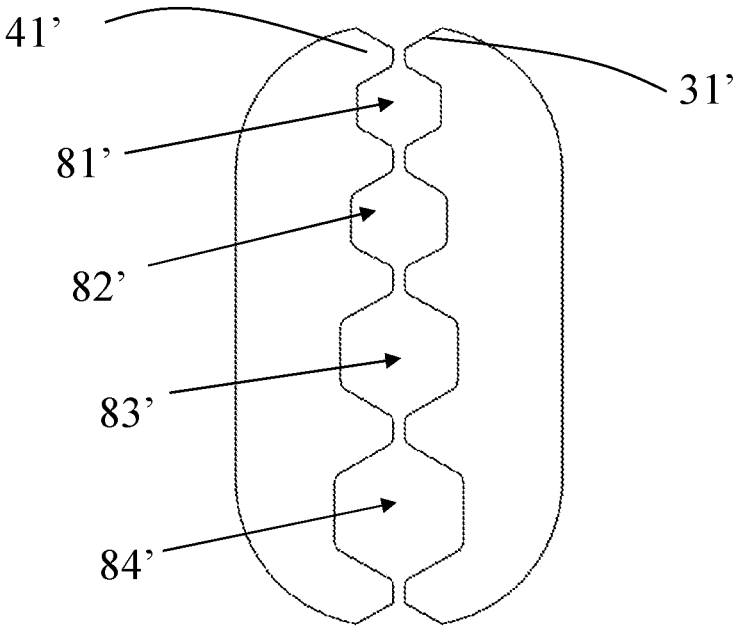
FIG. 11 is a schematic diagram of a first set of left accessory and right accessory according to Embodiment 5 of the disclosure.
Figure 12:
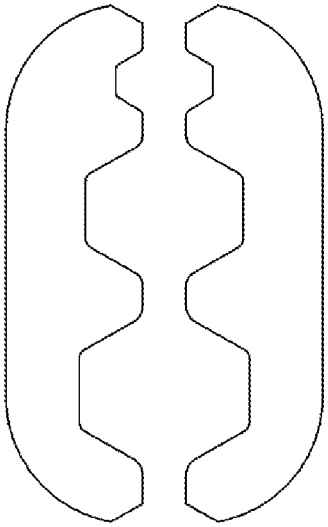
FIG. 12 is a schematic diagram of a second set of left accessory and right accessory according to Embodiment 5 of the disclosure.

Now reference is made to FIGS. 11 and 12, which is different from the first embodiment, Embodiment 5 provides two different sets of left accessories and right accessories, and in other embodiments, there may be three, four sets or even more.

As shown in FIG. 11, the number of cavities formed after the left accessory and the right accessory are matched with each other is four, and the four cavities (81', 82', 83', 84') are of different sizes and are arranged in sequence according to their sizes. The largest cavity 84' or the smallest cavity 81' can be set proximate to the jaw by turning over, which is convenient for operation in a dead corner such as a corner of a wall. Shapes of the four cavities are set according to a shape of the clamped object, and all of the shapes are hexagonal in this embodiment.

Figure 13:
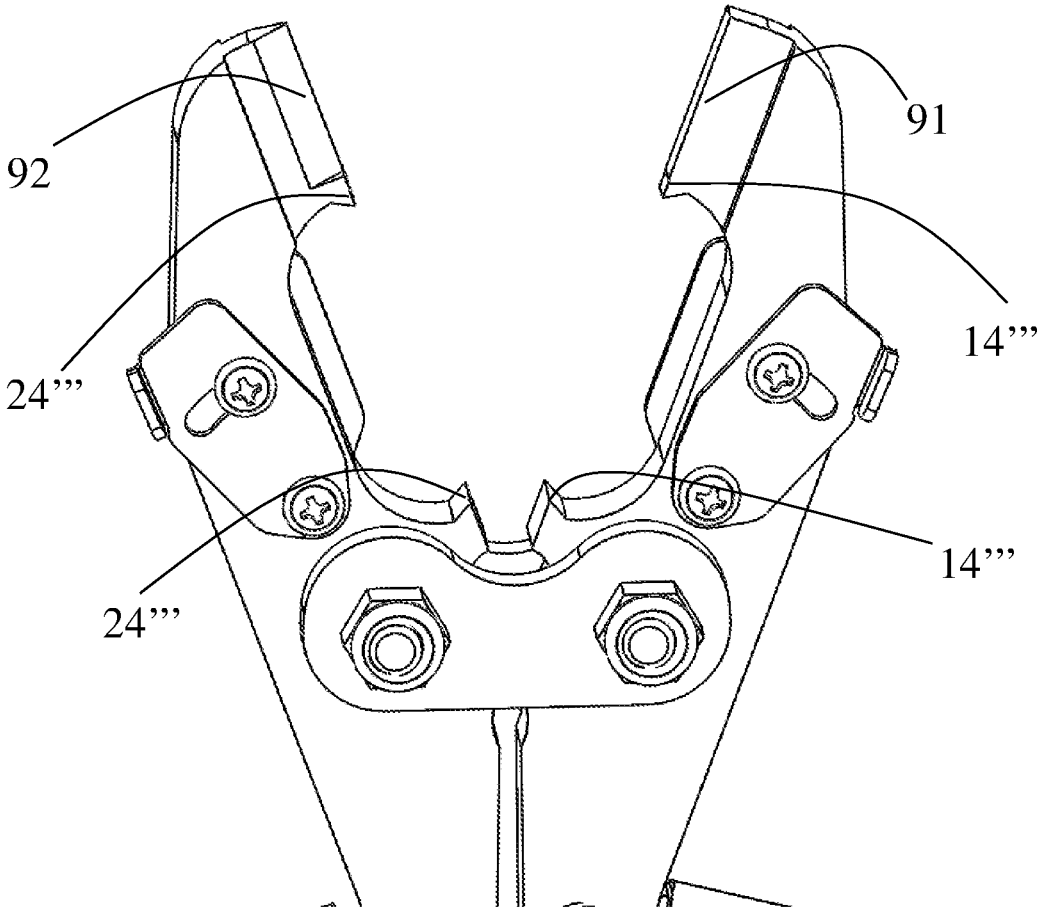
FIG. 13 is a schematic diagram of a plier head in an open state with the left and right accessory removed according to Embodiment 6 of the disclosure.

The left and right accessories shown in FIG. 12 differ from the left and right accessories in FIG. 13 only in the number and size of the cavities.

The sizes of the cavities in FIG. 12 and FIG. 11 are also different, and thus more functional expansion can be realized by replacing different sets of left and right accessories.

Embodiment 6

Figure 14:
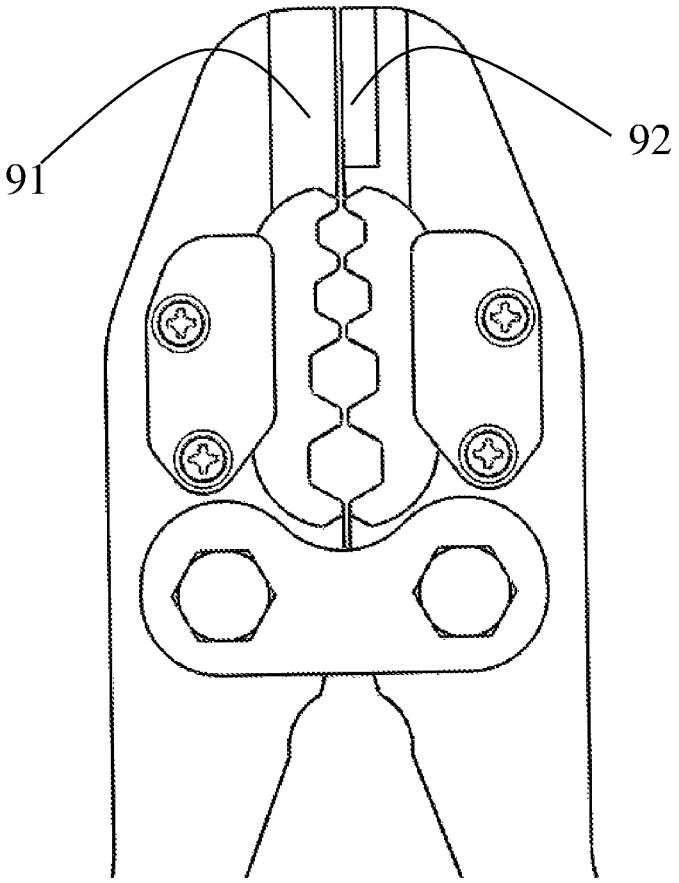
FIG. 14 is a schematic diagram of the plier head in a closed state with the left accessory and the right accessory assembled according to Embodiment 6 of the disclosure.

Now reference is made to FIGS. 13 and 14, a plier head with another structure is provided in Embodiment 6, and a shape and structure of the plier head in Embodiment 6 are substantially the same as those in Embodiment 1, and only differences are explained below.

As shown in FIG. 12 and FIG. 11, the left and right accessories in this embodiment are exactly the same as those in Embodiment 5, and the side walls of the two sets of left and right accessories are not provided with any left protrusion and right protrusion, and thus smooth side walls are beneficial to turning over or replacing the accessories. In order to further fix the accessories, chamfers (31', 41') are symmetrically arranged at the upper and lower ends of the left and right accessories, and protrusions (including left protrusions and right protrusions) corresponding to the chamfers are provided in corresponding positions (both ends) of the inner walls of the left and right accommodating cavities matched with the left and right accessories, that is to say, there are two pairs of left protrusions 14''' and right protrusions 24'''.

In Embodiment 6, ends of the left plier head 1 and the right plier head 2 proximate to the jaw are respectively provided with a left clipping part 91 and a right clipping part 92 matched with each other for clipping.

It should be understood by those skilled in the art that in the disclosure of the utility model, the orientation or positional relationship indicated by the terms "upper", "lower", "front", "rear", "left", "right", "vertical", "horizontal", "top", "bottom", "inner" and "outer" or the like are based on the orientation or positional relationship shown in the drawings, which are only for convenience of describing the utility model and for simplifying the description, but do not indicate or imply that the indicated device or element must have a specific orientation, be constructed and operate in a specific orientation; therefore the above-mentioned terms cannot be understood as limitations to the utility model.

Although the utility model has been disclosed by the preferred embodiment in the above, it is not intended to limit the utility model and any person familiar with the art can make some changes and embellishments without departing from the spirit and scope of the utility model; therefore, the scope of protection of the utility model should be subject to the scope of protection as claimed in the claims.

What is claimed is:

1. A plier head with good adaptability, comprising:

a left plier head;

a right plier head matched with the left plier head;

a left accessory detachably connected to the left plier head; and a right accessory detachably connected to the right plier head, the right accessory and the left accessory cooperating with each other to form at least one cavity;

wherein the plier head has at least two use states comprising a first state and a second state, and when the plier head is switched into the first state or the second state, a position of the at least one cavity is changed;

wherein the left plier head has a left accommodating cavity for accommodating the left accessory, and the right plier head has a right accommodating cavity for accommodating the right accessory, inner walls of the left accommodating cavity and the right accommodating cavity are symmetrical with respect to a symmetrical plane;

wherein a fixing structure is provided on a side of each of the left and right accommodating cavities to fix positions of the left and right accessories, each fixing structure comprising a fixing piece and at least two shafts, an end of the fixing piece is rotatable around one of the shafts, the other end of the fixing piece is provided with a sliding hole or a sliding groove, and the other of the shafts is inserted into the sliding hole or the sliding groove and is slidably arranged along the sliding hole or the sliding groove so that the fixing piece completely exposes or partially covers the left or right accommodating cavity.

2. The plier head with good adaptability according to claim 1, wherein when the plier head is in the first state, the left accessory and the right accessory are positively connected with the left plier head and the right plier head respectively; and when the plier head is in the second state, the left accessory and the right accessory are reversely connected with the left plier head and the right plier head respectively; a positive or reverse connection of the left accessory to the left plier head is determined by turning over the left accessory and a positive or reverse connection of the right accessory to the right plier head is determined by turning over the right accessory, so as to switch different use states of the plier head.

3. The plier head with good adaptability according to claim 1, wherein a baffle is provided on the other side of each of the left and right accommodating cavities, opposite the respective fixing structure.

4. The plier head with good adaptability according to claim 1, wherein the inner wall of the left accommodating cavity and the left accessory are respectively provided with a left protrusion and a left groove matched with the left protrusion, and the inner wall of the right accommodating cavity and the right accessory are respectively provided with a right protrusion and a right groove matched with the right protrusion.

5. The plier head with good adaptability according to claim 4, wherein the left protrusion and the right protrusion both comprises a tongue and a neck, the tongue is connected to the left accessory or the inner wall of the left accommodating cavity through the neck.

6. The plier head with good adaptability according to claim 1, wherein two ends of the inner wall of the left accommodating cavity extend toward inside of the left accommodating cavity, and two ends of the inner wall of the right accommodating cavity extend toward inside of the right accommodating cavity.

7. The plier head with good adaptability according to claim 1, wherein the plier head also has a third state and a fourth state, when the plier head is in the third state, the left accessory is positively connected to the left plier head and the right accessory is reversely connected to the right plier head; and when the plier head is in the fourth state, the left accessory is reversely connected to the left plier head, and the right accessory is positively connected to the right plier head.

8. The plier head with good adaptability according to claim 1, wherein ends of the left plier head and the right plier head proximate to a jaw are respectively provided with a left clipping part and a right clipping part which are matched with each other for clipping.

9. A plier, comprising:

a left clamp handle and a right clamp handle;

the plier head with good adaptability according to claim 1; and a pivot structure connected with the left plier head, the right plier head, the left plier handle, and the right plier handle respectively.

10. The plier head with good adaptability according to claim 3, wherein the inner wall of the left accommodating cavity and the left accessory are respectively provided with a left protrusion and a left groove matched with the left protrusion, and the inner wall of the right accommodating cavity and the right accessory are respectively provided with a right protrusion and a right groove matched with the right protrusion.

11. The plier head with good adaptability according to claim 10, wherein the left protrusion and the right protrusion both comprises a tongue and a neck, the tongue is connected to the left accessory or the inner wall of the left accommodating cavity through the neck.

12. The plier head with good adaptability according to claim 3, wherein two ends of the inner wall of the left accommodating cavity extend toward inside of the left accommodating cavity, and two ends of the inner wall of the right accommodating cavity extend toward inside of the right accommodating cavity.

13. The plier according to claim 9, wherein when the plier head is in the first state, the left accessory and the right accessory are positively connected with the left plier head and the right plier head respectively; and when the plier head is in the second state, the left accessory and the right accessory are reversely connected with the left plier head and the right plier head respectively; a positive or reverse connection of the left accessory to the left plier head is determined by turning over the left accessory and a positive or reverse connection of the right accessory to the right plier head is determined by turning over the right accessory, so as to switch different use states of the plier head.

14. The plier according to claim 13, wherein a baffle is provided on a side of each of the left and right accommodating cavities, and a fixing structure is provided on the other side of each of the left and right accommodating cavities to fix positions of the left and right accessories.

* * * * *